US006752683B1

(12) United States Patent
Godfrey

(10) Patent No.: US 6,752,683 B1
(45) Date of Patent: Jun. 22, 2004

(54) ANIMATED FIGURE

(76) Inventor: Thomas P. Godfrey, 12488 Woodcrest Dr., Omaha, NE (US) 68137

( * ) Notice: Subject to any disclaimer, the term of this patent is extended or adjusted under 35 U.S.C. 154(b) by 0 days.

(21) Appl. No.: 10/658,020

(22) Filed: Sep. 9, 2003

(51) Int. Cl.[7] ..... A63H 7/00

(52) U.S. Cl. ..... 446/356; 446/355; 446/377; 446/383

(58) Field of Search ..... 446/330, 351, 446/352, 353, 354, 355, 356, 376, 377, 381, 383, 390, 276

(56) References Cited

U.S. PATENT DOCUMENTS

| | | | | |
|---|---|---|---|---|
| 61,416 | A | 1/1867 | Goodwin | |
| 1,422,436 | A | 7/1922 | Gorgellino | |
| 1,927,558 | A | 9/1933 | Sumisky | 46/40 |
| 2,135,783 | A * | 11/1938 | Arnold | 446/353 |
| 3,484,988 | A * | 12/1969 | Robbins | 446/355 |
| 3,650,065 | A | 3/1972 | Johmann | 46/118 |
| 3,940,879 | A * | 3/1976 | Glass et al. | 446/276 |
| 4,177,602 | A * | 12/1979 | Choi | 446/355 |
| 5,224,896 | A * | 7/1993 | Terzian | 446/355 |
| 5,888,138 | A * | 3/1999 | Suganuma | 463/68 |
| 6,244,924 | B1 | 6/2001 | Liu | 446/352 |
| 6,290,567 | B1 * | 9/2001 | Chiu | 446/356 |
| 6,602,106 | B2 * | 8/2003 | Cheung | 446/330 |

FOREIGN PATENT DOCUMENTS

| | | |
|---|---|---|
| WO | WO 94/01188 | 1/1994 |

* cited by examiner

*Primary Examiner*—Jacob K. Ackun
*Assistant Examiner*—Bena B. Miller
(74) *Attorney, Agent, or Firm*—Thomte, Mazour & Niebergall; Shane M. Niebergall

(57) ABSTRACT

An animated figure is provided with a body and at least one jointed appendage that is pivotably coupled thereto. Motive force is provided to a shaft having a cam which is coupled to a follower formed within the appendage to pivot the appendage with respect to the body. A control rod extends between the cam and the joint of the appendage to enable the joint to bend as the appendage is pivoted. Additional joints and control rods may be provided depending on the appendage movement desired. Likewise, multiple appendages, including a neck and head, may be provided and coupled to one another to impart a natural movement to the figure, such as walking or running.

20 Claims, 5 Drawing Sheets

ANIMATED FIGURE

BACKGROUND OF THE INVENTION

The present invention relates to animated figures and more particularly to an animated figure that incorporates the use of a plurality of cams and control rods to impart fluid and natural movements to the appendages of the animated figure.

DESCRIPTION OF THE PRIOR ART

Animated figures are frequently used for indoor and outdoor displays relating to various holidays, products, or simply for decoration. Typically, the animated figure is provided with a body portion and at least one appendage, such as an arm, a head, or a set of legs that moves with respect to the body portion. A motor is disposed within the body portion and coupled to the appendage through a mechanical connection that permits the appendage to move. However, regardless of their level of complexity, prior art animated figures have failed to provide fluid and lifelike appendage movement. Rather, the motion of the appendages on prior art animated figures appears mechanical and fails to follow a natural range of motion.

U.S. Pat. No. 4,177,602 discloses an automated figure that is provided with movable leg members., The leg members are jointed at the knee and coupled to a body portion at the "hip." A motor within the body portion rotates a cam member that is connected to the leg, beneath the knee joint, by an elongated connecting rod. While the rotating cam does move the leg in a generally forward walking motion, it lacks the fluid, natural range of motion exhibited by the leg of an animal or a person. No joint is provided at the "ankle" of the leg, and the required engagement of the connecting rod between a pair of fulcrum pins creates a mechanical and somewhat clumsy motion.

U.S. Pat. No. 61,416 discloses an automatic toy in the shape of a horse. The toy is provided with a simple wind-up motor that is geared to extend and retract a plurality of pivotably coupled bars that extend through the length of each leg member. Each leg is comprised of an upper leg portion, lower leg portion, and a hoof. Both the upper and lower leg portions are provided with a pair of the rods, which are pivotably linked to one another at their end portions. Each of the joints in the leg members are provided with at least three pivot points that enable the joints to bend. Accordingly, as the motor operates in a forward direction, the legs are extended and retracted in a gimping motion. However, the motion attained by the skeleton of pivotably linked bars is machinelike and limited in its range of motion. Moreover, the assembly of such a jointed skeletal system is fairly complex and is susceptible to frequent mechanical failures due to the intricate structure.

Accordingly, what is needed is an improved system and method for providing an animated figure with fluid and natural appendage movement.

SUMMARY OF THE INVENTION

The animated figure of the present invention is generally provided with at least one jointed appendage, which is pivotably coupled to a body portion. A motor is provided within the animated figure and selectively rotates a shaft, which is positioned adjacent the appendage. A first cam is coupled to a follower groove within the appendage so that the appendage will pivot with respect to the body when the shaft is rotated. In a preferred embodiment, a first control rod is pivotably coupled to the first cam at one end and pivotably coupled at its other end to the appendage adjacent the joint. Accordingly, as the first cam rotates and the appendage pivots, the control rod bends the appendage at the joint. In another embodiment, a second joint can be provided within the appendage to serve as an "ankle" or "wrist" of the appendage. A second control rod may be coupled to the appendage adjacent the first and second joints. In this configuration, when the first joint bends, the second joint will bend.

The animated figure of the present invention can be provided with pairs of appendages and, where a four-legged animal is to be portrayed, forward and rearward pairs of appendages can be provided. Each of the appendages can be provided with one or more joints and control rods to move in response to the rotation of a cam in the same manner as the previously described appendage. The motion of each of the separate appendages can be mechanically timed with one another to provide the appearance of the independently-moving appendages of any two- or four-legged figure. Moreover, this same structural design could be provided to create moving "arms" for the animated figure.

In still another embodiment, neck and head portions are provided to the animated figure and are pivotably coupled to one another and the body. An eccentric cam secured to the shaft imparts forward and rearward motion to the neck. A control rod, which is coupled to the neck and head portions, pivots the head as the neck pivots. This provides the appearance of independent head and neck movement while the animated figure is in motion.

Accordingly, one of the principal objects of the present invention is to provide an animated figure having one or more appendages that move in a fluid and natural manner with respect to the body of the figure.

A further object of the present invention is to provide an animated figure having a plurality of appendages that fluidly and naturally move in concert with one another to emulate the natural motion of a two- or four-legged figure.

Still another object of the present invention is to provide an animated figure with neck and head portions that move naturally in concert with one or more appendages of the figure.

Yet another object of the present invention is to provide an animated figure that displays fluid and natural movement characteristic of the particular animal or person that the figure is emulating.

A further object of the present invention is to provide an animated figure that utilizes at least one cam and at least one control rod to provide fluid and natural motion to an appendage of the figure.

Still another object of the present invention is to provide an animated figure having a simple and durable structural design that exhibits fluid and natural appendage movement.

These and other objects of the present invention will be clear to those of skill in the art.

DESCRIPTION OF THE PREFERRED EMBODIMENT

Figure 1:
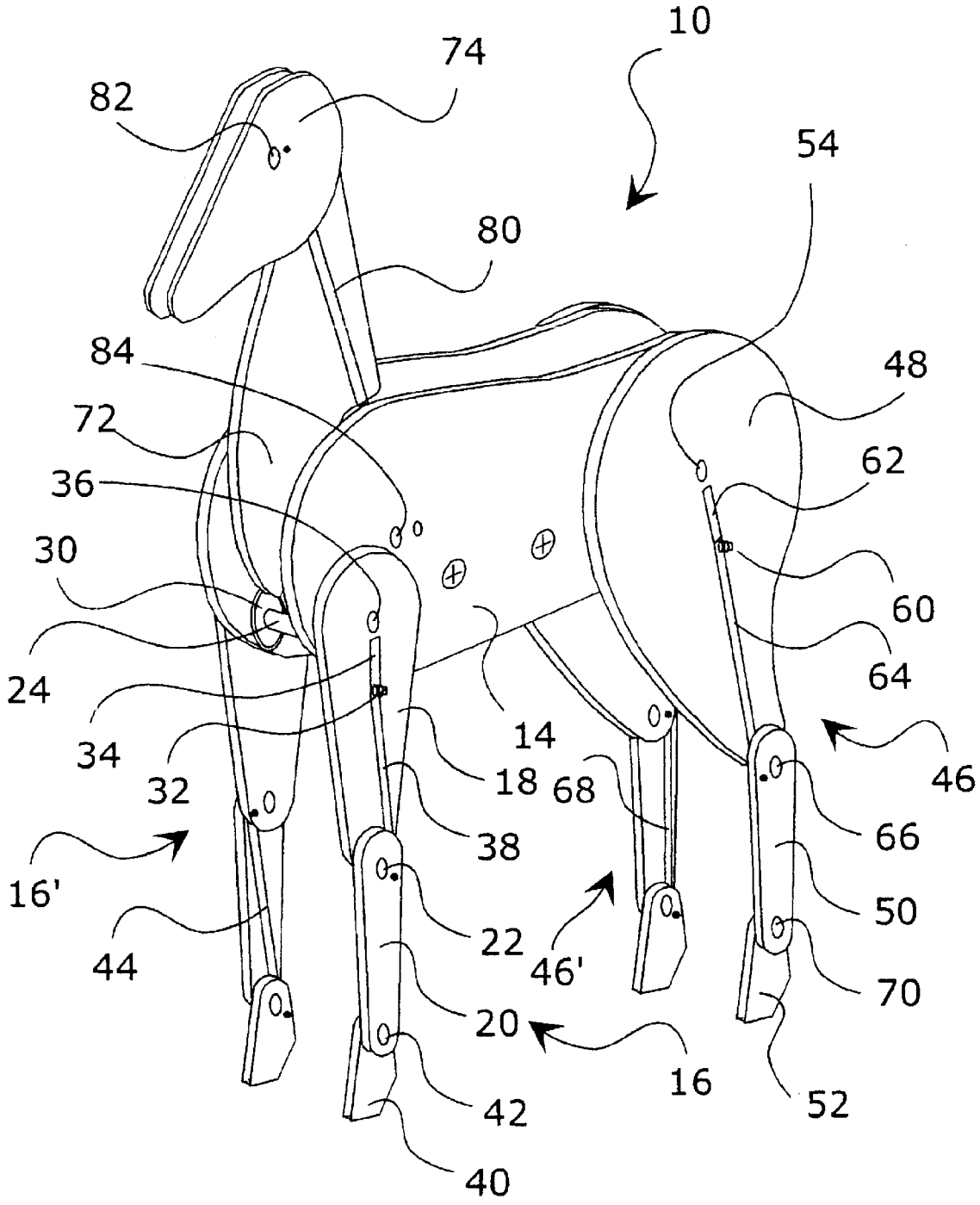
FIG. 1 is a perspective view of one embodiment of the animated figure of the present invention.

The animated figure 10 of the present invention is generally depicted in FIGS. 1–5. Although the animated figure 10 is depicted as being a four-legged animal, it is contemplated that the inventive concepts of the present invention will be equally applicable to the creation of two-legged figures, figures with arms and legs, figures with moving neck and head portions, and any desired combination of such body parts. For purposes of conciseness, however, the animated figure 10 of the present invention will be generally described as being a four-legged animal.

The animated figure 10 is generally provided with a body frame 12, which may further incorporate one or more body plates 14. At least one appendage 16, such as a leg, arm, neck, head or tail, will be pivotably coupled to the body frame 12 and/or body plates 14. In the present example, the appendage 16 is a leg having an upper segment 18, which is pivotably coupled to a lower segment 20 at a first joint 22. The upper segment 18 is pivotably coupled to the body plate 14 so that it may be selectively pivoted in forward and rearward directions with respect to the body plate 14.

An axle 24 is rotatably coupled to the body frame 12 adjacent the upper segment 18 of the appendage 16. The axle 24 is selectively rotated with respect to the body frame 12 by a motor 26. The motor 26 may be of any conventional type, including, but not limited to, electrical, internal combustion, or a stored tension motor that uses a spring that is manually wound with a key. It is further contemplated that the motor 26 could simply be manually operated through a crank or similar means when desired. Regardless, the motor 26 is operatively coupled to the shaft 24 through a belt 28 and/or a plurality of matable gear members. Accordingly, as the motor 26 is engaged, rotational movement is imparted upon the axle 24.

A cam 30 is coupled to the axle 24 so that the cam 30 rotates with the axle 24. Although the cam 30 is generally depicted as being round and disc-shaped, it will be apparent to those of skill in the art that the cam 30 may be provided in nearly any shape, according to the given working parameters. A pin 32 is secured to the cam 30 so that the pin 32 extends outwardly therefrom. A generally elongated follower groove 34 is formed in the upper segment 18 of the appendage 16 and is preferably shaped to at least partially receive a portion of the pin 32 therein. The follower channel 34 is provided with opposite ends and a length extending therebetween, along which the pin 32 may freely travel. Accordingly, as the cam 30 is rotated, the pin 32 will travel along the follower groove 34 while the pin 32 and cam 30 travel along their generally orbital path. This action imparts a fluid and natural pivoting motion to the upper segment 18 about the pivot point 36. The characteristics of the pivoting motion can be easily changed by the modification of the location, length and/or shape of the follower groove 34.

In a preferred embodiment, an upper control rod 38 is pivotably coupled at one end to the pin 32 and is pivotably coupled to the lower segment 20 adjacent the joint 22 at its other end. Accordingly, as the pin 32 and cam 30 rotate, the upper control rod 38 will bend the appendage 16 at the joint 22. The proximity with which the upper control rod 38 is coupled to the lower segment 20 adjacent the joint 22 will determine the characteristics of the bending motion of the joint 22. Accordingly, a combination of the pin 32 and follower groove 34 along with the upper control rod 38 impart a fluid and natural movement to the appendage 16 at its pivot point 36 and the joint 22.

It may be desirable to include a third or bottom segment 40 to the appendage 16 to provide a hand, foot or hoof to the appendage 16. Preferably, the bottom segment 40 is pivotably coupled to the lower segment 20 at a second joint 42. Controlled bending of the second joint 42 can be obtained by providing the appendage 16 with a lower control rod 44 which is pivotably coupled to the upper segment 18 adjacent the joint 22 at one end and pivotably coupled to the bottom segment 40 adjacent the second joint 42. Accordingly, lower control rod 44 will work in concert with the upper control rod 38 in response to the rotation of the cam 30 and the pin 32 to bend the second joint 42 as the appendage 16 moves with respect to the body plate 14.

Where desired, an opposing appendage 16' can be provided opposite appendage 16. The opposing appendage 16' is preferably constructed in much the same manner as that described for appendage 16. Movement of the opposing appendage 16' is at least partially provided through a second cam 30', which is coupled to the shaft 24 opposite the first cam 30. The position of the cams 30 and 30' as they are coupled to the shaft 24 can be selectively adjusted to time the movement of the appendages 16 and 16' to provide a fluid and natural walking or running movement to the animated figure 10.

Figure 2:
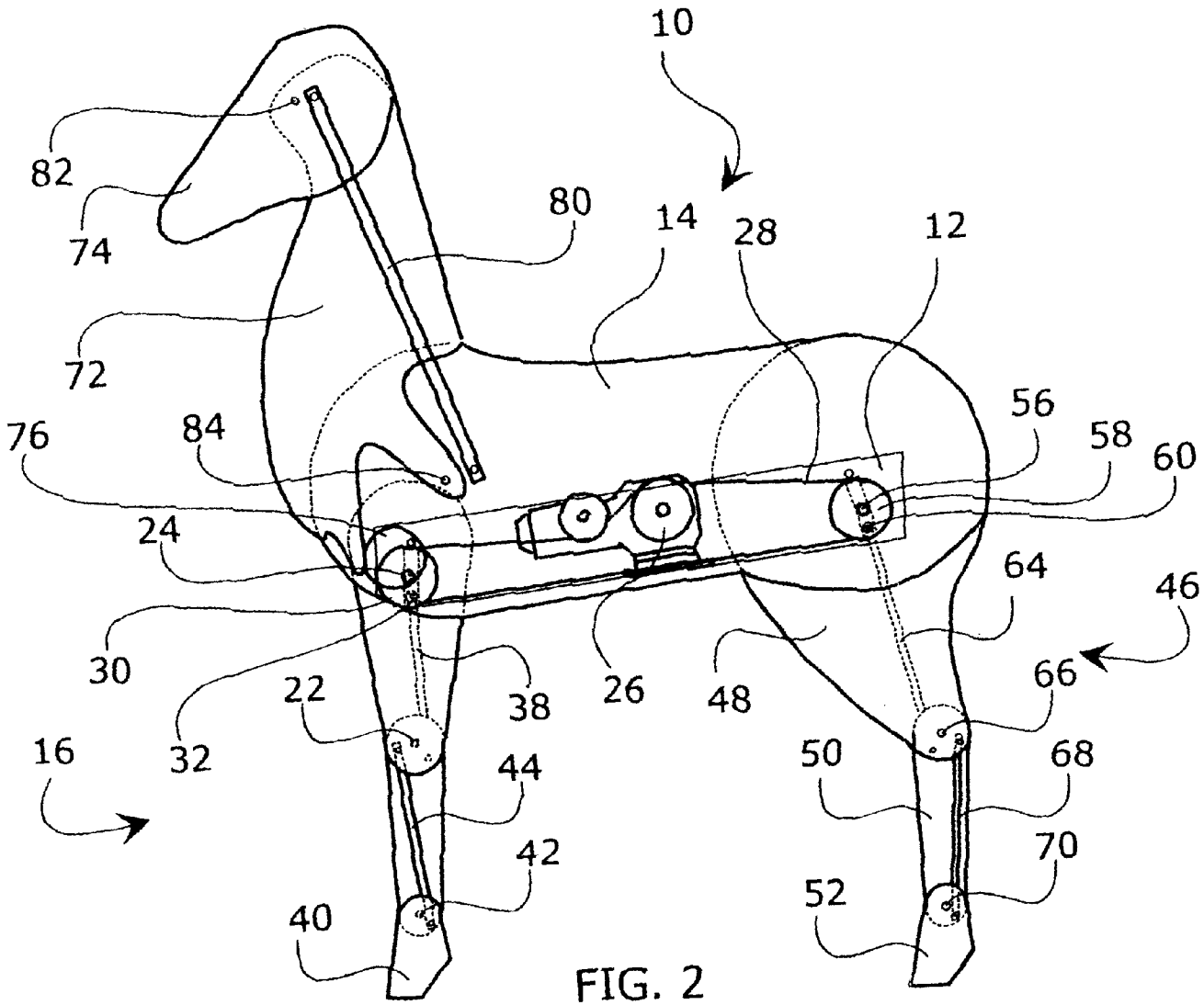
FIG. 2 is a side elevation view of the animated figure of FIG. 1.
Figure 3:
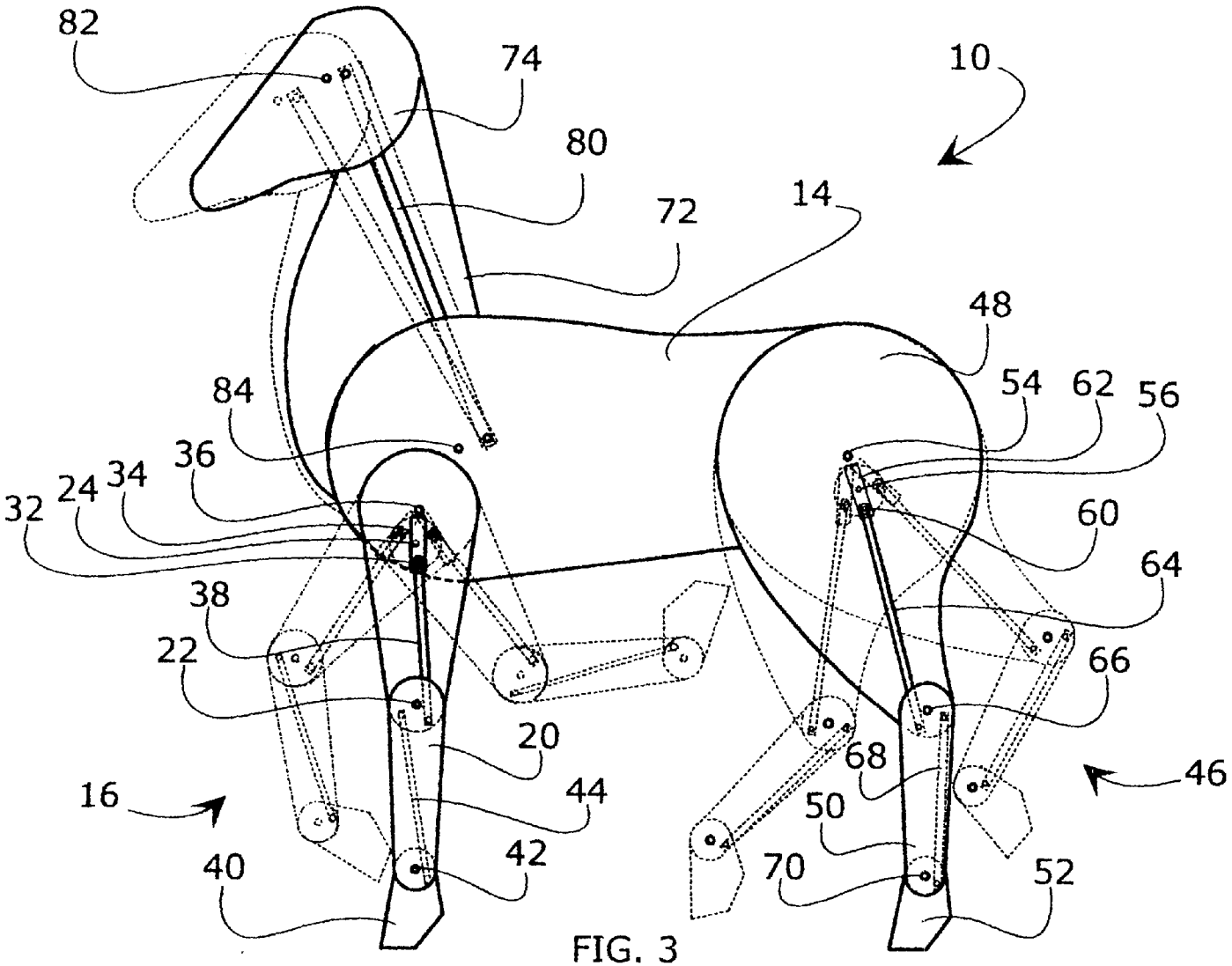
FIG. 3 is a side elevation view of the animated figure of FIG. 1 demonstrating some of the fluid and natural appendage movements that can be obtained with the depicted embodiment.
Figure 4:
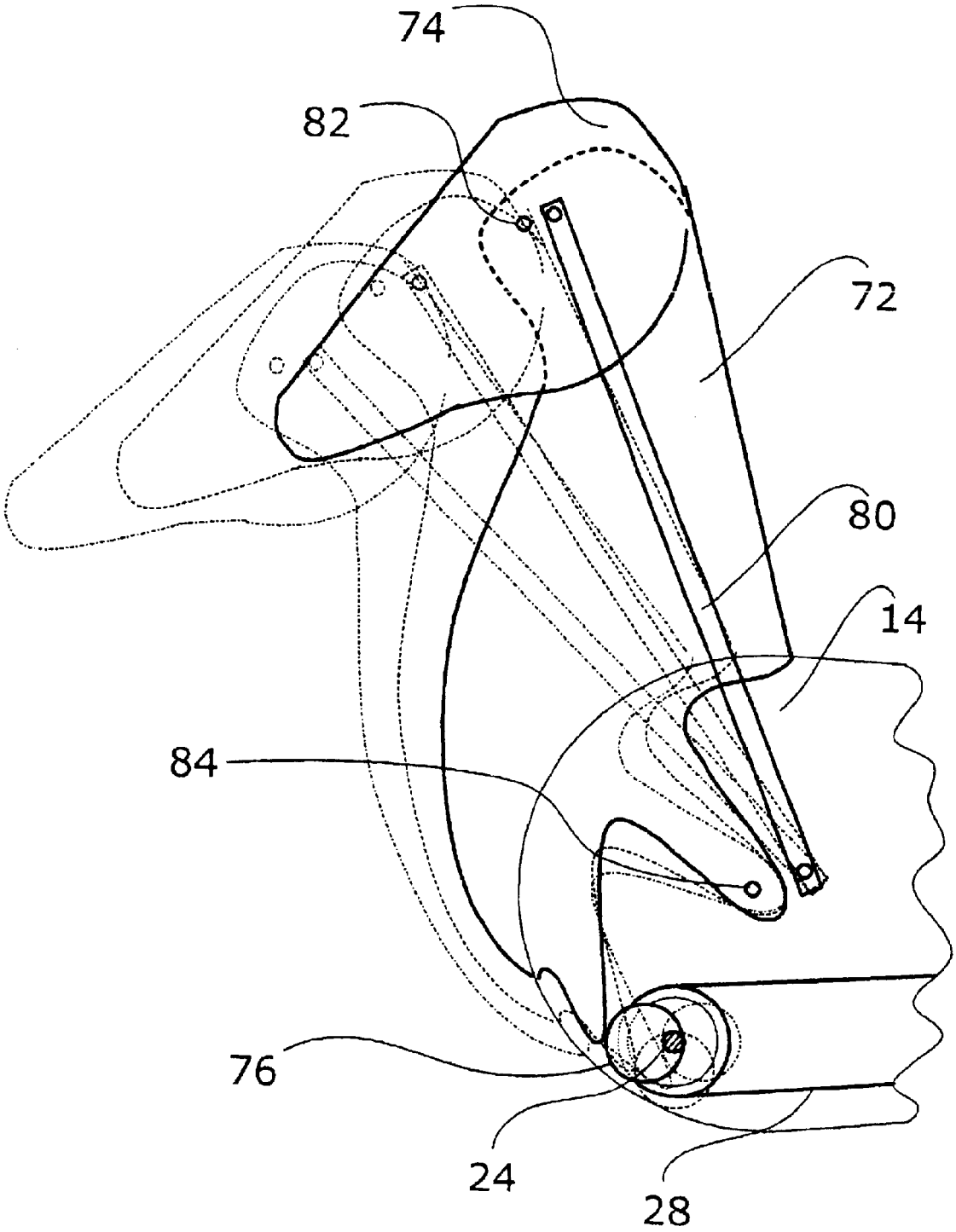
FIG. 4 is a partial side view of the head and neck portions of one embodiment of the present invention demonstrating some of the fluid and natural movements that can be obtained with the depicted embodiment.
Figure 5:
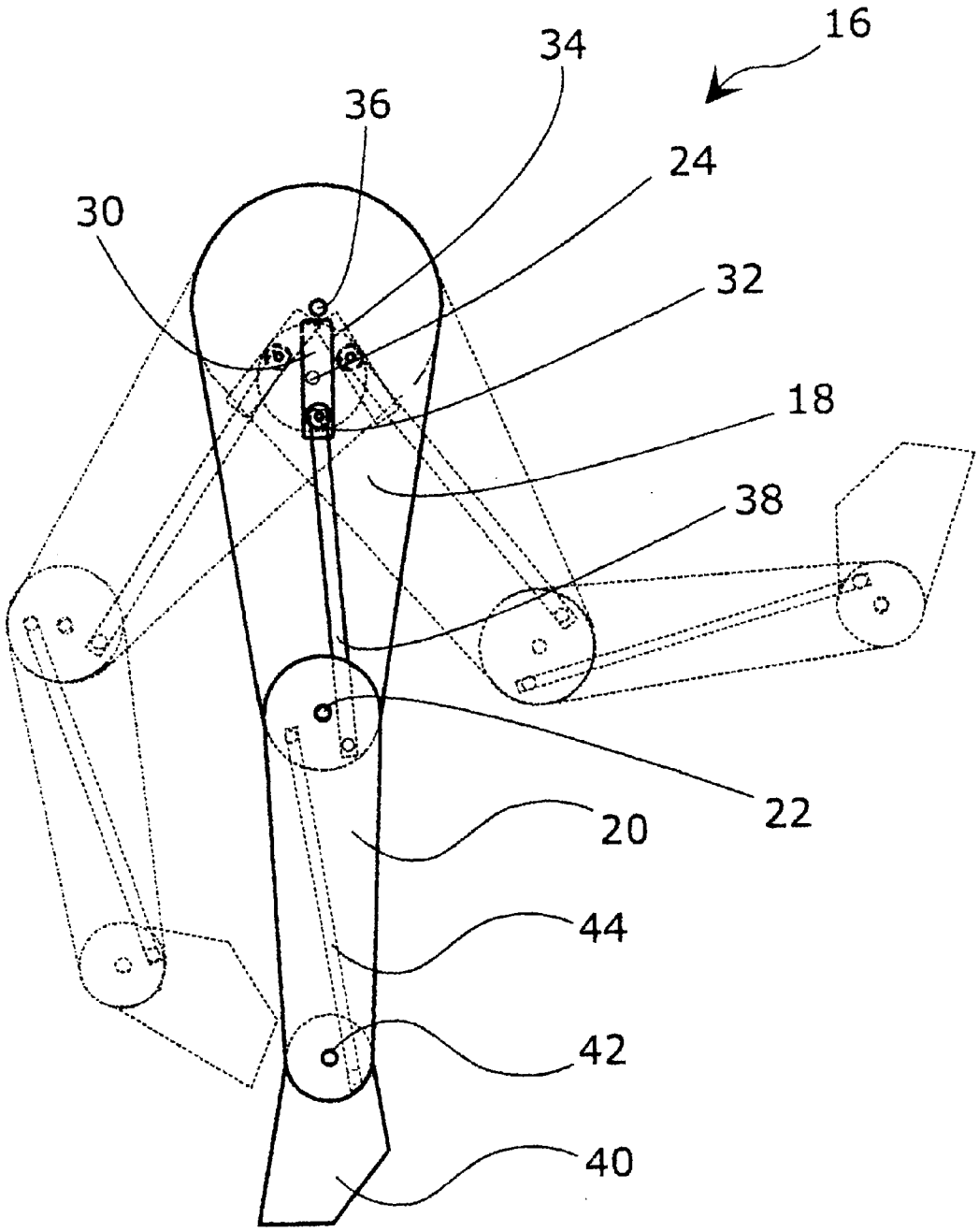
FIG. 5 is a partial side view of an appendage of one embodiment of the present invention demonstrating some of the fluid and natural movements that can be obtained with the depicted embodiment.

Additional appendages may be also provided, such as the example of the rear legs 46 and 46' depicted in FIGS. 1–3. It is preferred that the structure of the legs 46 and 46' be similar to one another. Accordingly, for purposes of conciseness, only the leg 46 will be described herein. The leg 46 is preferably provided with at least an upper segment 48 and a lower segment 50 and may be optionally provided with a third or bottom segment 52. The upper segment 48 is pivotably coupled to the body plate 14 at the point 54. A rear axle 56 is pivotably coupled with the body frame 12 and is operatively coupled to the motor 26 much in the same fashion as that described for axle 24. A third cam 58 is secured to the rear axle 56 so that it rotates therewith. A pin member 60 extends outwardly from the third cam 58 and is at least partially received by, and slidably movable within, a follower groove 62 formed in the upper section 48 of the leg 46. The movement imparted to the upper segment 48 by the movement of the pin 60 within the follower groove 62 is similar to that described previously for pin 32 and the follower groove 34. An upper control rod 64 is coupled to the pin 60 and pivotably coupled to the leg 46 adjacent a joint 66, which pivotably couples the upper segment 48 with the lower segment 50. Where a bottom segment 52 is provided, it is preferred that a lower control rod 68 be coupled to the upper segment 48 adjacent the joint 66 at one end and pivotably coupled to the bottom segment 52 adjacent a joint 70, which pivotably couples the lower segment 50 with the bottom segment 52. It is preferred that the cams that movably couple the legs 46 and 46' to the rear axle 56 be oriented to time the movement of the legs 46 and 46' to impart a natural walking or running motion to the same. Similarly, it is preferred that the movement of legs 46 and 46' be timed to move in cooperation with the appendages 16 and 16' to further create the appearance of a natural motion among the appendages. It is contemplated that, in the example where a bipedal figure is desired, that the legs 46 and 46' will be timed to move in cooperation with appendages 16 and 16', which might serve as the figure's arms.

The animated figure 10 may optionally be provided with a neck portion 72, which is preferably pivotably coupled with the body frame 12 and/or the body plates 14 at a pivot point 84. A head portion 74 may then be secured atop the neck portion 72. It is preferred that the head portion be pivotably coupled to the neck portion 72 so that the two structures may pivot at least slightly with respect to one another. Motion may be imparted to the neck portion 72 and the head portion 74 through a neck cam 76, which is preferably secured to the axle 24 such that the neck cam 76 rotates therewith. As the neck cam 76 rotates, it engages the lower end portion 78 of the neck portion 72 so that the neck portion 72 pivots rearwardly and forwardly in response to such engagement. It is contemplated that the shape of the neck cam 76 could be provided to effectuate the desired rate and character of movement imparted upon the neck portion 72. A neck control rod 80 is preferably provided and pivotably coupled at one end to the body plate 14 and/or the body frame 12 and pivotably coupled at the opposite end to the head 74. Accordingly, depending on the location that the opposite end portions of the neck control rod 80 are coupled to these structures and their respective pivot points 82 and 84, the characteristics of the head motion with respect to the neck 72 and the body plate 14 will vary. Preferably, the shape of the neck cam 76 as well as the location of the neck control rod 80 will be provided such that the head and neck cooperate in a fluid and natural forward and rearward motion with respect to the body frame 14 and further cooperate with the appendages 16, 16', 46 and 46' to facilitate the fluid and natural movement of the animated figure 10 as a whole.

In the drawings and in the specification, there have been set forth preferred embodiments of the invention; and although specific items are employed, these are used in a generic and descriptive sense only and not for purposes of limitation. Changes in the form and proportion of parts, as well as substitution of equivalents, are contemplated as circumstances may suggest or render expedient without departing from the spirit or scope of the invention as further defined in the following claims.

Thus it can be seen that the invention accomplishes at least all of its stated objectives.

I claim:

1. An animated figure, comprising:

a body frame;

an elongated appendage, having first and second segments and a first joint operatively pivotably coupling said first and second segments to one another; said first segment being operatively pivotably coupled to said body frame;

a motor operatively coupled to said body frame;

an axle operatively rotatably coupled to said body frame and said motor so that said axle may be selectively rotated with respect to said body frame by actuation of said motor;

a cam coupled to said axle so that said cam rotates with said axle;

a control rod having first and second end portions; said first end portion of said control rod being operatively pivotably coupled to said cam by a pin member; said second end portion of said control rod being operatively pivotably coupled to said appendage adjacent said first joint;

said pin member being at least partially received and slidably movable within a channel formed in the first segment of said appendage so that said appendage pivots with respect to said body frame and bends at said first joint when said cam is rotated.

2. The animated figure of claim 1 wherein said appendage is further provided with a third segment which is operatively pivotably coupled to said second segment at a second joint; said appendage being further provided with a second control rod having first and second end portions; said first end portion of said second control rod being operatively pivotably coupled to said appendage adjacent said first joint; said second end portion of said second control rod being operatively coupled with said appendage adjacent said second joint.

3. The animated figure of claim 2 further comprising a second appendage having first and second segments and a first joint operatively pivotably coupling said first and second segments to one another; said first segment of said second appendage being operatively pivotably coupled to said body frame.

4. The animated figure of claim 3 further comprising a second cam operatively coupled to said axle so that said second cam rotates with said axle; said second cam being further operatively coupled to said second appendage.

5. The animated figure of claim 4 further comprising a third control rod having first and second end portions; said first end portion of said third control rod being operatively and pivotably coupled to said second cam by a second pin member; said second end portion of said third control rod being operatively coupled with said second appendage adjacent said first joint.

6. The animated figure of claim 5 wherein said second pin member is at least partially received and slidable within a channel formed in the first segment of said second appendage so that, when said second cam is rotated, said second pin travels along a length of said channel and pivots the first end portion of said second appendage with respect to said body frame.

7. The animated figure of claim 6 wherein said second appendage is further provided with a third segment which is operatively pivotably coupled to said second segment at said a second joint; said second appendage being further provided with a fourth control rod having first and second end portions; said first end portion of said fourth control rod being operatively pivotably coupled to said second appendage adjacent said first joint; said second end portion of said fourth control rod being operatively coupled with said second appendage adjacent said second joint.

8. The animated figure of claim 1 further comprising a neck member operatively pivotably coupled to said body frame and a head member operatively pivotably coupled to said neck member.

9. The animated figure of claim 8 further comprising a neck cam coupled to said axle so that said neck cam rotates with said axle.

10. The animated figure of claim 9 further comprising an elongated neck rod having first and second end portions; said first end portion of said neck rod being operatively coupled to said head member; said second end portion of said neck rod being operatively pivotably coupled with said body frame; said neck member being operatively engaged with said neck cam so that, as said neck cam rotates, said neck member and said head member pivot with respect to said body frame.

11. The animated figure of claim 1 further comprising a pair of leg members having upper and lower portions; said upper portions being operatively pivotably coupled to said body frame.

12. The animated figure of claim 11 further comprising a leg axle operatively rotatably coupled to said body frame and said motor so that said leg axle may be selectively rotated upon actuation of said motor.

13. The animated figure of claim 12 further comprising a pair of leg cams coupled to said leg axle so that said pair of leg cams rotate with said leg axle; said leg cams each being operatively engaged with one of said pair of leg members so that said pair of leg members pivot with respect to said body frame when said pair of leg cams rotate.

14. The animated figure of claim 13 wherein said pair of leg members are each provided with at least a first joint which operatively and pivotably couples said upper and lower portions of said leg members to one another.

15. The animated figure of claim 14 wherein said pair of leg members are each provided with an upper control rod having first and second end portions; said first end portions of said upper control rods being operatively coupled to said leg cams; said second end portions of said control rods being operatively coupled with said pair of leg members so that when said leg cams rotate said first joint in both of said leg members pivot.

16. The animated figure of claim 15 wherein said pair of leg members are each provided with a third segment which is operatively pivotably coupled to said second segment at a second joint; each of said leg members being further provided with a lower control rod having first and second end portions; said first end portions of said lower control rods being operatively coupled to said leg members adjacent said first joints; said second end portions of said lower control rods being operatively coupled to said leg members so that when said joint cams rotate, said second joints in both of said leg members pivot.

17. An animated figure, comprising:

a body frame;

an elongated appendage having upper and lower portions pivotably coupled to one another at a joint; said upper portion being operatively pivotably coupled to said body frame;

an axle operatively coupled to said body frame;

means for selectively rotating said axle with respect to said body frame;

means rotatable with said axle and operatively coupled to the upper portion of said appendage for selectively and simultaneously pivoting the upper portion of said appendage with respect to said body frame and bending the joint in said appendage.

18. The animated figure of claim 17 further comprising a plurality of appendages operatively pivotably coupled to said body frame.

19. The animated figure of claim 18 wherein said means for pivoting the upper portion of said body frame is further operative for selectively pivoting each of said plurality of appendages with respect to said body frame.

20. The animated figure of claim 19 wherein each of said plurality of appendages is jointed, and said means for pivoting said appendages is further operative for bending said plurality of appendages at said joints.

* * * * *